US012269080B2

(12) United States Patent
Erarslan et al.

(10) Patent No.: US 12,269,080 B2
(45) Date of Patent: Apr. 8, 2025

(54) MODULAR ROLLING TRAIN, PARTICULARLY HOT ROLLING TRAIN, PREFERABLY IN CONJUNCTION WITH AN UPSTREAM CASTING FACILITY

(71) Applicant: SMS group GmbH, Düsseldorf (DE)

(72) Inventors: Gokhan Erarslan, Düsseldorf (DE); Jens Kreikemeier, Lennestadt (DE); Joachim Hafer, Siegen (DE); Kerstin Spill, Netphen (DE)

(73) Assignee: SMS group GmbH, Düsseldorf (DE)

( * ) Notice: Subject to any disclaimer, the term of this patent is extended or adjusted under 35 U.S.C. 154(b) by 312 days.

(21) Appl. No.: 17/784,302

(22) PCT Filed: Dec. 3, 2020

(86) PCT No.: PCT/EP2020/084376
§ 371 (c)(1),
(2) Date: Jun. 10, 2022

(87) PCT Pub. No.: WO2021/115900
PCT Pub. Date: Jun. 17, 2021

(65) Prior Publication Data

US 2023/0056053 A1 Feb. 23, 2023

(30) Foreign Application Priority Data

Dec. 11, 2019 (DE) ..... 10 2019 219 318.8
May 15, 2020 (DE) ..... 10 2020 206 174.2

(51) Int. Cl.
*B21B 13/22* (2006.01)

(52) U.S. Cl.
CPC ..... *B21B 13/22* (2013.01)

(58) Field of Classification Search
CPC ..... B21B 13/22; B21B 1/46; B21B 31/08; B21B 31/10; B21B 31/103
See application file for complete search history.

(56) References Cited

U.S. PATENT DOCUMENTS 3,245,672 A 4/1966 Loeck et al.
3,518,862 A 7/1970 Laminage
(Continued)

FOREIGN PATENT DOCUMENTS

CN 1195584 A 10/1998
CN 1978081 C 8/2008
(Continued)

OTHER PUBLICATIONS

Modernisation Du Laminoir a Chaud De Shagang En Chine//Hot Strip Mill Modernization at Shagang, China, Authors: Jian L, et al, Publication data: Revue de metallurgie—Cahiers d'informations techniques,,Jul. 1, 2003, Source info: vol. 100, Nr: 7/08, pp. 713-727.

(Continued)

*Primary Examiner* — Teresa M Ekiert
(74) *Attorney, Agent, or Firm* — Smartpat PLC

(57) ABSTRACT

A modular rolling train, particularly a hot rolling train, preferably in conjunction with an upstream casting facility, and a method for operating a modular rolling train are described. The rolling train is standardized and modularized by dividing the rolling train into discrete units n and by modularization of the discrete units. The rolling train can be flexibly adapted to new requirements by exchanging a module.

22 Claims, 3 Drawing Sheets

(56) References Cited

U.S. PATENT DOCUMENTS

| | | | | |
|---|---|---|---|---|
| 3,861,190 | A | 1/1975 | Maltby et al. | |
| 4,038,857 | A | 8/1977 | Eibe et al. | |
| 5,038,591 | A | 8/1991 | Tajima et al. | |
| 5,461,770 | A * | 10/1995 | Kimura | B21B 1/466 29/33 C |
| 5,564,178 | A | 10/1996 | Takashima et al. | |
| 5,634,257 | A * | 6/1997 | Kajiwara | B21B 1/26 148/541 |
| 5,970,594 | A | 10/1999 | Borsi et al. | |
| 6,062,055 | A | 5/2000 | Bobig et al. | |
| 6,244,090 | B1 | 6/2001 | Viavant | |
| 8,011,418 | B2 * | 9/2011 | Rosenthal | B21B 1/46 164/269 |
| 2003/0167817 | A1 | 9/2003 | Seidel et al. | |
| 2006/0196243 | A1 | 9/2006 | Viavant | |
| 2009/0013745 | A1 | 1/2009 | Rackel | |
| 2010/0077824 | A1 | 4/2010 | Mittermayr | |
| 2010/0116380 | A1 | 5/2010 | Seidel et al. | |
| 2011/0154877 | A1 | 6/2011 | Breuer et al. | |
| 2011/0272116 | A1 | 11/2011 | Benedetti et al. | |
| 2012/0073345 | A1 * | 3/2012 | Diez | B21B 35/04 72/227 |
| 2012/0160377 | A1 | 6/2012 | Seidel et al. | |
| 2015/0343524 | A1 | 12/2015 | Witschas et al. | |
| 2016/0107212 | A1 | 4/2016 | Calcoen et al. | |
| 2020/0061685 | A1 | 2/2020 | Seidel et al. | |
| 2023/0060110 | A1 | 2/2023 | Kreikemeier et al. | |

FOREIGN PATENT DOCUMENTS

| | | | |
|---|---|---|---|
| CN | 201172064 | | 12/2008 |
| CN | 101809173 | A | 8/2010 |
| CN | 103084402 | A | 5/2013 |
| CN | 103464463 | A | 12/2013 |
| CN | 101961728 | B | 3/2014 |
| CN | 102549173 | B | 7/2014 |
| CN | 102240674 | B | 12/2014 |
| CN | 101945715 | B | 1/2015 |
| CN | 204159642 | U | 2/2015 |
| CN | 204448821 | U | 7/2015 |
| CN | 205732274 | U | 11/2016 |
| CN | 105142811 | B | 1/2018 |
| CN | 107413856 | B | 2/2019 |
| DE | 3811875 | A1 | 4/1989 |
| DE | 10046426 | A1 | 3/2002 |
| DE | 69905332 | | 10/2003 |
| DE | 602004007631 | | 4/2008 |
| DE | 102008029581 | A1 | 1/2009 |
| DE | 202011110779 | U1 | 5/2016 |
| DE | 102017200731 | A1 | 5/2018 |
| EP | 3003590 | | 12/2014 |
| EP | 2943296 | A1 | 11/2015 |
| EP | 3486001 | A1 | 5/2019 |
| GB | 2198982 | A | 1/1991 |
| JP | S51107254 | A | 9/1976 |
| JP | S6117303 | U | 1/1986 |
| JP | S62275508 | A | 11/1987 |
| JP | S6313601 | A | 1/1988 |
| JP | S6313603 | A | 1/1988 |
| JP | S6434505 | A | 2/1989 |
| JP | H10286611 | A | 10/1998 |
| JP | 2002210506 | B | 4/2002 |
| JP | 2004298932 | B | 6/2005 |
| JP | 2005262279 | B | 4/2011 |
| JP | 2013501144 | A | 1/2013 |
| JP | 2016520004 | | 7/2016 |
| RU | 2252829 | C2 | 5/2005 |
| WO | 2011015365 | A1 | 2/2011 |
| WO | 2013042204 | A1 | 3/2013 |
| WO | 2018086762 | A1 | 5/2018 |

OTHER PUBLICATIONS

"Non-ferrous Plastic Processing of Metals", Yanhuanthus, p. 60, Metallurgical Industry Press, Jan. 1982, 1st Edition.

Kao Kao Kao, et al., pp. 204-205, Metallurgical Industry Press, Oct. 1995, 1st Edition.

The State Intellectual Property Office of People's Republic of China, Office Action in related application CN202080086181.8.

Jens Kreikemeier et al., co-pending U.S. Appl. No. 17/784,354, national phase entry of PCT/EP2020/085853.

Murugabhoopathy, K., R. Satish, and R. Shanmuga Prakash. "Study on improving the rolling and its allied practices to achieve high productivity, quality, improved techno-economic factors and equipment reliability in hot rolling mill of salem steel plant." AIP Conference Proceedings. vol. 2128. No. 1. AIP Publishing LLC, 2019.

* cited by examiner

MODULAR ROLLING TRAIN, PARTICULARLY HOT ROLLING TRAIN, PREFERABLY IN CONJUNCTION WITH AN UPSTREAM CASTING FACILITY

TECHNICAL FIELD

The disclosure relates to a modular rolling train, particularly a hot rolling train, preferably in conjunction with an upstream casting facility, and to a method for operating a modular rolling train.

BACKGROUND

Rolling trains are used to form metallic starting products. In hot rolling trains in particular, starting products are formed from a primary shape into an intermediate or final dimension in the hot state. For this purpose, the hot-rolling mills can be directly connected to a continuous casting line. Typically, a hot rolling train has an equalizing or reheating furnace for heating and/or homogenizing the primary product to the desired forming temperature and other units. Depending on the end products to be produced, for example the material, the target dimension or the desired degree of forming, such units are then combined in sequence in a line to form a rolling train. Typically, these are roll stands, transport sections, cooling equipment, separating equipment, heating equipment and/or surface treatment equipment. This results in a rolling train that can only be adjusted with great effort.

By analogy, this also applies to cold rolling trains, where typically the temperatures and/or forming are smaller and the tolerated dimensional or quality deviations, as the case may be, are smaller.

Due to the fixed configuration of the respective rolling train, the optimization of the manufacturing process is only possible to a limited extent, in particular against the background of increasing demands on the finished products in terms of material properties and quality. However, it is not possible to adjust the rolling mill at short notice beyond the adjustment of a single unit.

SUMMARY

It is an object of the disclosure to improve a rolling train such that it can be flexibly adjusted to different finished products, process designs, dimensions, materials and/or quality requirements.

The object is achieved by a modular rolling train as claimed and a method for operating a modular rolling train as claimed.

A rolling train is subdivided into discrete units (n) and at least one discrete unit (n) has at least two modules (m). At least one module (m) of the subdivided discrete unit (n) is interchangeable with another module (m) by means of transport equipment assigned to the discrete unit (n), preferably automatically and/or by automatic means. By dividing the rolling train into discrete units and subdividing the discrete units into modules, the modularization of the rolling train is achieved. The discrete units and/or modules form technical and/or process and/or material units by means of which, upon an exchange, the rolling train and thus the process control can be optimized and/or adjusted in such a manner that certain properties of a finished product and/or alternative or new finished products can be produced. This also includes optimizing the productivity of the rolling train if, for example, the exchange of a furnace module can be done faster than the time required to adjust the furnace's process parameters for a modified finished product.

By exchanging a module by means of a transport device assigned to the discrete unit, the modules can be exchanged for one another in a more rapid and less complicated manner than if a normal rebuild process of the rolling train takes place, such as during a maintenance shutdown. The exchange preferably takes place laterally and substantially perpendicularly, particularly preferably perpendicularly, to the longitudinal extension of the throughput section. This is supported in particular by systematic standardization of the modules used. Preferably, if the exchange is automatic, the interfaces of the modules should comply with uniform standards in terms of media supply, positioning, control or regulation. This also facilitates the replacement of modules during maintenance work. An exchange with an automatic means preferably takes over the substantial work steps when two modules are exchanged and reduces the manual activity in the process.

Preferably, at least one subdivided discrete unit is formed by a technical system, in particular by a roughing rolling unit, a finishing rolling unit, at least one transport unit and/or at least one heat treatment unit of the rolling train, and a module of the subdivided discrete unit is formed by an assembly of the technical unit, preferably by a set of rolls of a roughing stand, a set of rolls of a finishing stand, a roll table, an enclosed roll table, a furnace module, a cooling section, a separating unit, a surface treatment unit and/or measuring equipment. By exchanging individual or more such modules, adjustment to different finished products can take place with particular ease.

Furthermore, it is preferred if the modules assigned to a discrete unit can at least be exchanged with one another. With this design, it is even possible that different modules can be used within the discrete unit and thus different process designs can be realized. For example, in a multi-part furnace unit, one furnace module can be replaced by a cooling section or a roll table. The fact that this can be used at different positions as a replacement and/or within and/or in addition to the furnace unit means that very different heat treatment processes can be flexibly implemented.

In a further embodiment, at least in the case of two discrete units, modules can be exchanged between one another by means of a transport operation between the respective assigned transport devices. This allows modules that perform similar functions to be used at or in different discrete units. For example, a roll table can be used both between the roll stands and in the region of a furnace unit. As a result, the number of modules kept in stock can be reduced and the capital expenditure is lowered.

Preferably, a base length, preferably 0.25 m to 5 m, even more preferably 0.25 m to 1 m, is provided for dividing the rolling train into a length grid, and the dimensions of the discrete units and/or the modules of the rolling train correspond to a base length or are integer multiples of the base length. This represents an easy way to standardize the units or modules, as the case may be. Even if parts of the rolling train are designed as conventionally fixed units, this design facilitates maintenance and, if necessary, a rebuild of the rolling train.

Ideally, a subdivided discrete unit is formed by a heat treatment unit, and at least one module of the heat treatment unit is formed by a furnace, roll table, enclosed roll table, cooling section, surface treatment and/or measuring section module. Targeted heat treatment represents a significant factor in setting the properties of the finished product.

Improved adjustment options for the line allow new features or optimizations to be made rapidly.

At least one furnace module is designed as a roller hearth furnace module or as an induction heating module. By exchanging such modules, ideal temperature control can be realized rapidly during heat treatment, which is not possible or can be modified in this form and/or speed with permanently installed systems.

Furthermore, it is preferred if a subdivided discrete unit is formed by a roughing rolling unit and at least one module of the roughing rolling unit is formed by a roughing stand, preferably with two driven work rolls and/or two support rolls. In particular, adjustments of the set of work rolls with a diameter difference of ≥6%, preferably of ≥10%, in the region of the rough rolling allow a rapid response to a modified cast product or starting product.

It is preferable if a subdivided discrete unit is formed by a finishing rolling unit, and at least one module of the finishing rolling unit is formed by a finishing roll stand, preferably with two driven work rolls and/or two support rolls. By exchanging modules in such unit, it is possible to respond in particular to material properties, product characteristics and/or quality requirements. For example, the existing work rolls in a roll stand can be exchanged for work rolls that have a diameter difference of ≥6%, preferably of ≥10%. In the case of roll stands, it is also advantageous if work and/or support rolls can be exchanged with one another. Furthermore, cooling sections, roll tables or heating equipment can also be exchanged.

Preferably, the rolling train is a hot rolling train. In hot rolling trains, high furnace temperatures are usually provided and a change of temperature control requires a correspondingly long time in systems known from the prior art. By exchanging a hot furnace module with a colder one, for example, the temperature curve can be adjusted much more rapidly to a modified specification.

By means of a casting facility preferably connected upstream of the hot rolling train, different cast products, preferably different materials and/or dimensions, can be produced, and the cast products, in particular thin slabs, slabs or billets, can be fed to the hot rolling train directly after the casting and solidification process. In the sense used here, "direct" means that the cast products do not usually cool to ambient temperature. However, this may be necessary for certain material groups or types. In such a case, it is preferable to provide an option for removing or introducing and selectively heat-treating the cast products. In particular in the hot forming of cast products from low-pressure die casting with large variability of dimensions and materials, an adjustment of the roll gap can be advantageous. For cast products from continuous casting, optimization in terms of materials is usually the most effective.

Ideally, the casting facility is a continuous casting line and the ingot mold can be exchanged to change the dimensions of the cast product. By changing the ingot mold, the throughput of the continuous casting line can be varied rapidly for a fixed number of casting strands. This allows production output and quality to be matched, and the associated hot rolling train can also be adjusted by exchange modules.

A continuous casting line with an exchangeable ingot mold, a heat treatment unit before a roughing rolling unit, a heat treatment unit between the roughing and finishing rolling units and after the finishing rolling unit are provided, and the heat treatment unit has at least two modules between the roughing and finishing rolling units. In terms of basic design, this corresponds to a conventional hot rolling train, which can be flexibly adjusted to different dimensions and materials thanks to the modularization in accordance with the disclosure. The finished product in this case is preferably a hot-rolled strip or blank or a black rod. Through a preferred exchange of modules, preferably the modules of the heat treatment unit between the roughing and finishing rolling units, along with at least one of the two rolling units, the modular rolling train can be adjusted to different materials and dimensions.

Furthermore, it is preferred if there is higher-level control or regulation system for the hot rolling train and associated control or regulation system for the existing discrete units and/or modules, and if the higher-level control or regulation system can initiate and preferably execute a preferably automatic exchange of modules. Modularization significantly increases the flexibility and complexity of a hot rolling train compared to a state-of-the-art hot rolling train. An appropriate control or regulation system simplifies system management and the targeted optimization of the hot rolling train for different process runs and/or finished products.

Furthermore, the object of the disclosure is achieved by a method for operating a modular hot rolling train. In the event of a desired change in format, properties and/or material of the finished product, the process control in the hot rolling train is adjusted on the basis of predefined production parameters by means of the following work steps: Checking of the modules present in the throughput section as to whether the production parameters can be achieved by adjusting at least one of the modules, in particular roll gap adjustments and/or cooling parameters. Exchanging, preferably automatically, unsuitable modules with modules suitable for compliance with the production parameters. The exchange of unsuitable modules, in particular an automatic exchange, allows the hot rolling train to be adjusted to changed requirements without the need for time-consuming rebuilding. By exchanging modules with an existing transport device in conjunction with a modularized and standardized design, the time required for exchanging can be reduced to such an extent that the exchange of a module does not lead to any significant interruption of operation. Preferably, the modules are exchanged within 90 min., more preferably within 30 min., even more preferably within 10 min. Particularly preferably, the modules are exchanged laterally to the throughput section, very preferably laterally and perpendicular to the longitudinal extension of the throughput section.

Exchanging by means of a transport device means that one module of the hot rolling train can be replaced by another through a limited number of working steps. For this purpose, couplings to adjacent modules and/or connecting components are initially released, for example. Subsequently, the module is moved out by a horizontal and/or vertical displacement and another module is brought to such position. In the ideal case, the media supply should thereby remain in place. This allows furnace temperatures or atmospheres to be maintained, for example. For this purpose, the two modules can be detachably attached to a common device and the exchange takes place via a transverse displacement on a rail assembly. The module that is not in the throughput section can then be detached from the device if necessary and replaced with another. This significantly increases the flexibility and adjustability of the rolling train during ongoing operation.

The preferred higher-level control or regulation system suggests alternative formats and/or materials if no modules suitable for maintaining the production parameters can be exchanged with one another. This avoids production errors and increases process reliability, in particular if a large number of different modules are in stock. This alternative proposal makes equal sense with regard to logical production planning in the case of both existing and missing overlapping production planning of a steel mill and a rolling mill.

It is preferable if the higher-level control or regulation system uses process models for discrete units and/or modules for the control or regulation of the rolling train, preferably the hot rolling train. This simplifies the optimization of process specifications and improves the quality of the finished product.

Ideally, the higher-level control or regulation system exchanges data with a production planning system. This allows required modules to be prepared prior to the exchange. This can shorten a production interruption and/or ramp-up curve. For example, an off-line furnace module can be heated to a target temperature.

The higher-level control or regulation system, in conjunction with an production planning system, optimizes the production sequences in terms of material, dimensions, throughput and/or deadlines. This can reduce the number of exchanging processes to a necessary minimum.

DETAILED DESCRIPTION

The invention is described in detail below with reference to the specified figures in the form of exemplary embodiments. In all figures, the same technical elements are designated with the same reference signs.

Figure 1:
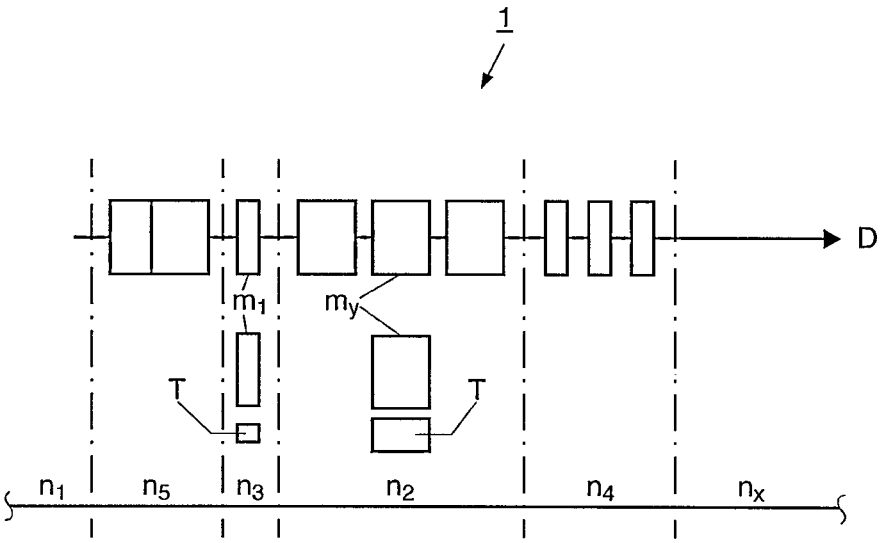
FIG. 1: System diagram of rolling train.

FIG. 1 shows a diagram of a rolling train 1 divided into discrete units n with $n_1$ to $n_x$. Some of the discrete units n have at least one subdivision into modules m with $m_1$ to $m_y$. In this example, the rolling train 1 is divided into the discrete units of heat treatment unit $n_2$, roughing rolling unit $n_3$, finishing rolling unit $n_4$ and transport unit $n_5$. The discrete units $n_2$ and $n_3$ have exchangeable modules m in this example. The modules are exchanged by means of a transport device T assigned to the discrete unit.

Figure 2:
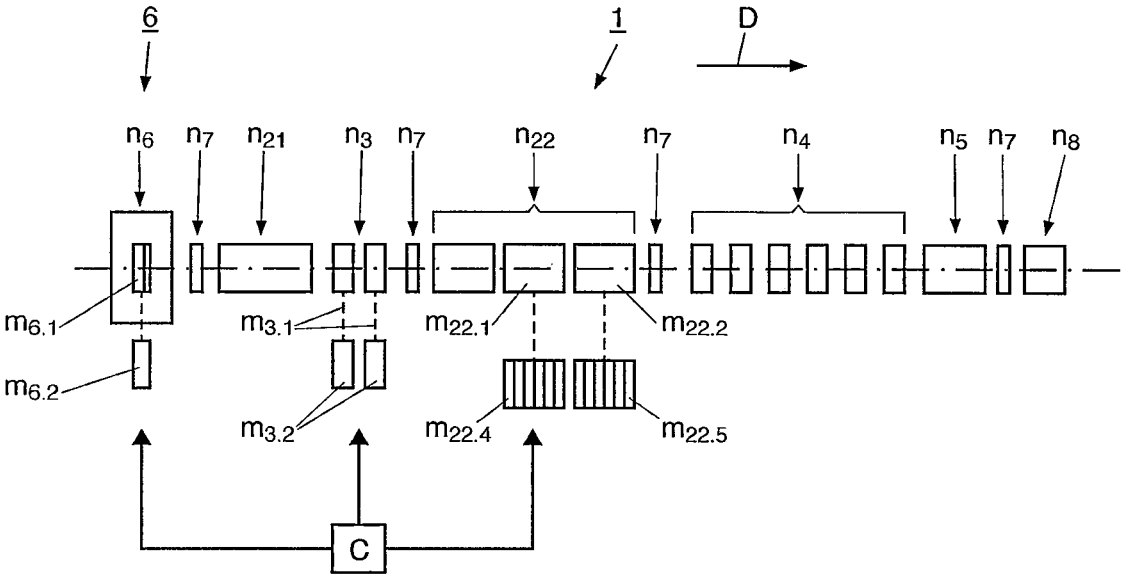
FIG. 2: System diagram of hot rolling train with continuous casting line.

FIG. 2 shows a schematic illustration of a hot rolling train 1 for a metallic flat product with an upstream continuous casting line 6. The continuous casting line 6 comprises at least one discrete unit $n_6$, the hot rolling train 1 has as discrete units n a pre-heating unit $n_{21}$, a roughing rolling unit $n_3$, an intermediate heating unit $n_{22}$, a finishing rolling unit $n_4$, a transport unit $n_5$ and a recoiling unit $n_8$, along with various separating units $n_7$. The rolling train 1 can have other units, such as scale washers, possible induction heaters, etc., in addition to the modules or units shown in the figure.

In this exemplary embodiment, the discrete unit $n_6$ of the continuous casting line 6 has an exchangeable module m in the form of the ingot mold. The ingot mold $m_{6.1}$ as module m of the continuous casting line 6 can be designed to be funnel-shaped. Alternatively, a parallel ingot mold $m_{6.2}$ is available as an exchange module. With a funnel-shaped ingot mold, a thickness tapering can already be carried out during the solidification process. It is particularly suitable for casting thicknesses in the range of 100 mm to 130 mm. With a parallel ingot mold $m_{6.2}$, particularly rapid solidification and a large casting thickness can be achieved. It can be used for larger casting thicknesses of 150 mm, for example, and preferably for the manufacturing of peritectic materials and tubular steels.

In the present exemplary embodiment, in accordance with FIG. 2, the pre-heating unit $n_{21}$ is designed as a non-modular discrete unit n. However, this could be replaced by a discrete unit with at least one exchangeable module. Thus, comparable modules m could be exchangeable with the intermediate heating unit $m_{22}$ described later.

In this exemplary embodiment, the roughing rolling unit $n_3$ is designed as a two-stand roughing rolling train in 4-roll design with driven work rolls. The number of stands can usually vary between 1 and 3. In this example, the exchangeable modules m are the sets of work rolls $m_{3.1}$ and $m_{3.2}$, which have different diameter ranges. The work roll diameter ranges between the two sets of rolls differ beyond the usual grinding range of a work roll of about 10% and allow modified forming conditions to be adjusted. For example, a work roll module $m_{3.1}$ can have a diameter range of 1050 mm to 950 mm and is used for the rough rolling of large casting thicknesses up to 150 mm. The exchangeable work roll module $m_{3.2}$ can have a diameter range of 950 mm to 850 mm, for example. The module exchange in the form of a set of work rolls for another set of work rolls with a different work roll diameter range produces a roll gap adjustment. The module exchange of the sets of work rolls $m_{3.1}$, $m_{3.2}$ is carried out by a transport device T in the form of a work roll changing device, which removes the work rolls to be changed from the stand and brings in the exchange rolls.

The example of the work roll diameter ranges of the sets of work rolls $m_{3.1}$ and $m_{3.2}$ shows that it is possible to match the dimensional ranges. These are quite intentional, as it provides complete and comprehensive coverage of technologically sensible production options, helping to improve production flexibility.

In this exemplary embodiment, the intermediate heating unit $n_{22}$ is in the form of a discrete unit with a fixed section and four modules $m_{22.1}$, $m_{22.2}$, $m_{22.4}$ and $m_{22.5}$. The two modules $m_{22.1}$ and $m_{22.2}$ are designed as individual roller hearth furnace modules and are arranged one after the other along the throughput section D. In addition, the modules $m_{22.4}$ and $m_{22.5}$ are available in the form of open roll tables as exchange modules. Through the exchange of module $m_{22.1}$ for exchange module $m_{22.4}$ and/or through the exchange of module $m_{22.2}$ for exchange module $m_{22.5}$, a partial length of intermediate heating unit $n_{22}$ is created from an open roll table where the roughing strip is subjected to corresponding cooling.

As a result, other module compositions are also conceivable. Thus, the number of modules along the throughput section D from $m_{22.1}$ to $m_{22.x}$ can be selected to be as large as desired, and the same applies to the number and/or type of exchange modules. Thus, in a variant not shown, a single roller hearth furnace module $m_{22.1}$ installed in the throughput section (D) can be exchanged for a single open roll table module $m_{22.4}$ or alternatively for an enclosed roll table module $m_{22.6}$ or alternatively a cooling section $m_{22.7}$, etc. An overhead crane can be used as the transport device T, but automated embodiments such as those described in more detail in FIG. 3 are preferred.

The finishing rolling unit $n_4$ of the present exemplary embodiment is designed as a non-modular discrete unit. In the exemplary embodiment, the finishing rolling unit $n_4$ is designed as a 6-stand finishing rolling train in 4-roll design with driven work rolls. In an alternative not shown, the finishing rolling mill $n_4$ can also be designed as a modular discrete unit. Then, following the principle of the roughing rolling unit $n_3$, exchange modules with different work roll diameters or cooling devices are suitable, but other exchange modules can also be provided in the form of intermediate stand devices, such as straightening units, additional cooling devices and/or intermediate stand heating devices.

The rolling train 1 further comprises a transport unit $n_5$, in the exemplary embodiment with an integrated cooling section module $m_{5.4}$, along with a recoiling unit $n_8$. The various possible embodiments of the cooling section module $m_{5.4}$ and the recoiling unit $n_8$ are known to the skilled person from the prior art.

The control device C shown here is connected in terms of signal technology to those discrete units n which have modules m. In the rolling train 1 shown, these are the continuous casting line 6 with modules $m_{6.1}$ and $m_{6.2}$, the roughing rolling unit $n_3$ with modules $m_{3.1}$ and $m_{3.2}$, along with the intermediate heating unit $n_{22}$ with modules $m_{22.1}$, $m_{22.2}$, $m_{22.4}$ and $m_{22.5}$.

Figure 3A:
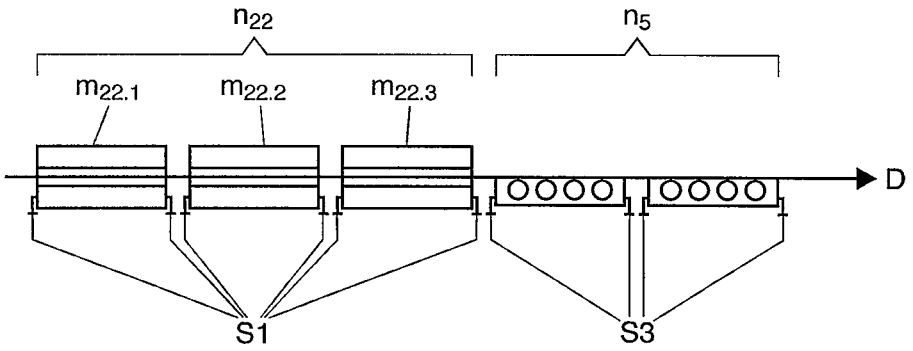
FIG. 3*a*: Side view illustrating a module exchange with a transport device using the example of a furnace module.
Figure 3B:
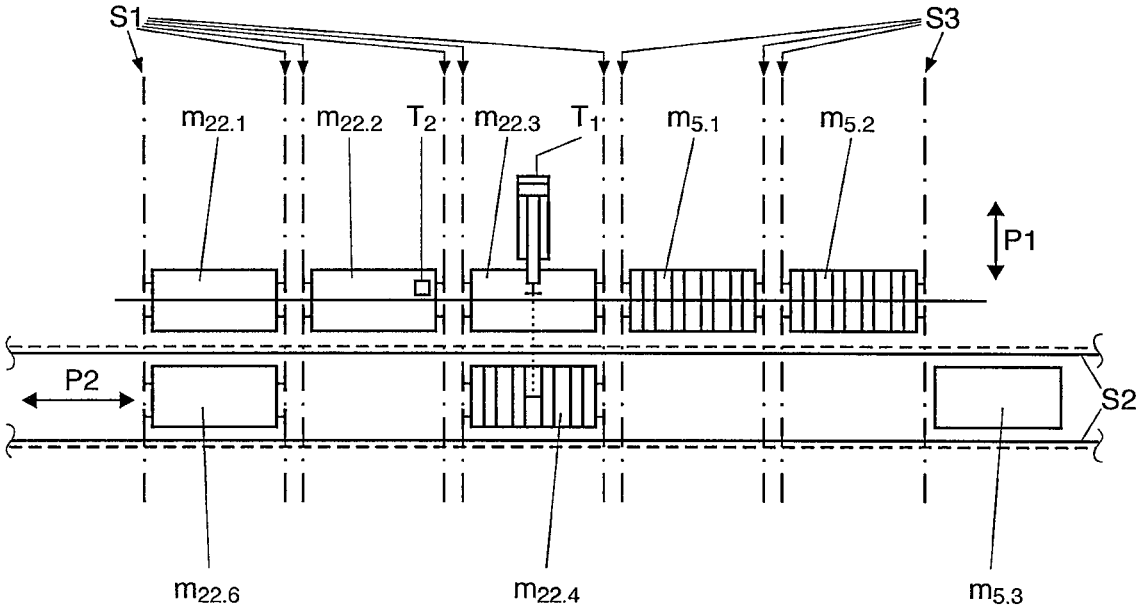
FIG. 3*b*: Top view illustrating a module exchange with a transport device using the example of a furnace module.

FIG. 3*a* and FIG. 3*b* schematically show the exchange of a module m with a transport device T using the example of an intermediate heating unit $n_{22}$, along with a transport unit $n_5$ in side view (FIG. 3*a*) and top view (FIG. 3*b*). In FIGS. 3*a* and 3*b*, various transport devices T and embodiments are shown combined with one another for example purposes.

The intermediate heating unit $n_{22}$ consists of three modules $m_{22.1}$, $m_{22.2}$ and $m_{22.3}$ arranged one behind the other in the throughput section D, which are designed as roller hearth furnace modules. Each of the modules m is mounted on a rail system S1 associated with the transport devices T, which extends transversely to the throughput section in the direction of the double arrow P1 and on which the module m that can be moved into or out of the throughput section can be transported. In the top view, such rail system is shown with dashed dots. Two exchange modules are mounted in a position adjacent to the throughput direction; in the present case, an open roll table $m_{22.4}$ and an enclosed roll table $m_{22.6}$ are positioned parallel to the throughput section D.

In one embodiment, the roller hearth furnace module $m_{22.3}$ can be exchanged simultaneously, through a connected operation, in a simple partially or fully automated manner with the open roll table module $m_{22.4}$. For this purpose, the cylinder $T_1$, as a further component of the transport device T, couples to the roll table module $m_{22.4}$, and the two modules are jointly displaced perpendicular to the throughput section D, such that the roll table module $m_{22.4}$ is now positioned in the throughput section.

In a further embodiment, illustrated using the example of the middle roller hearth furnace module $m_{22.2}$, either the module $m_{22.4}$ or the module $m_{22.6}$ can be used as an exchange module. For this embodiment, a second rail system S2 belonging to the transport device T must be provided parallel to the throughput section D, which extends through a double line with whole and dashed line in the direction of arrow P2. For exchanging the roller hearth furnace module $m_{22.2}$, the position on the second rail system S2 transverse to the throughput section D must initially be unoccupied. A drive device T2 belonging to the transport device T, in this variant as a motor with pinion and rack, transports the roller hearth furnace module $m_{22.2}$ out of the throughput section D onto the axis of the transport section in the direction of the arrow P2 and then moves it on the rail set S2. If the enclosed roll table module $m_{22.6}$ is to be introduced into the throughput section D, the modules m located on the rail set S2 are moved in such a manner that the module $m_{22.6}$ is located in front of the rail system of the transport device of the middle module and can then be transported into the throughput section D. The roller hearth furnace module $m_{22.1}$ can be exchanged in the same manner.

The exchange of modules m between two discrete units n is shown with respect to the transport unit $n_5$. The transport unit $n_5$ has two roll table modules $m_{5.1}$ and $m_{5.2}$, which can be moved along the rails S3 by means of assigned transport devices T. The transport options correspond to those described for the intermediate heating unit $n_{22}$. An additional inductive heating module $m_{5.3}$ is assigned to the $n_5$ transport unit. According to the method described above, the roll table module $m_{5.2}$ can be exchanged, for example for repair reasons, by the roll table module $m_{22.4}$ assigned to the intermediate heating unit $n_{22}$. The positioning and the displacement in the direction of the arrows P1 and P2 takes place as already described. Similarly, the inductive heating module $m_{5.3}$ assigned to the transport unit $m_5$ can replace the roll table module $m_{5.1}$ within the transport unit $n_5$ and thus increase the overall heating power, or alternatively it can be inserted at any position within the intermediate heating unit $n_{22}$ if required. The exchange of modules m between two different discrete units n can thus additionally extend the flexibility of the entire system.

Figure 4:
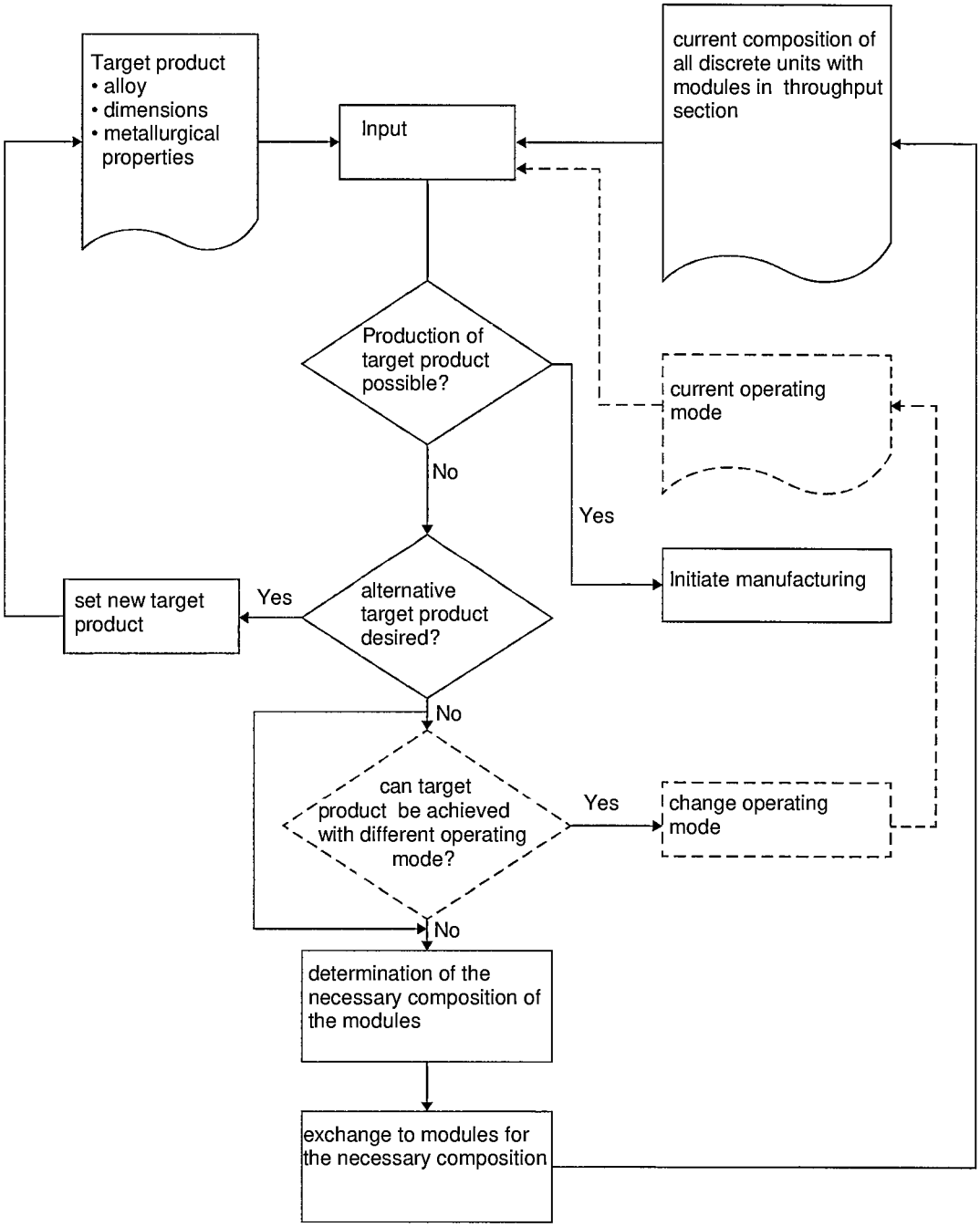
FIG. 4: Mode of operation of the higher-level control device.

FIG. 4 shows an exemplary embodiment of the mode of operation of a higher-level control unit C. The control unit C receives data regarding the target product to be manufactured with regard to the alloy, the dimensions and the metallurgical properties. In addition, the current composition of all discrete units $n_1$ to $n_x$ with their modules $m_1$ to $m_y$ in the throughput section D and the exchange modules must be known to control unit C. Such composition gives rise to a current system configuration. The next step is to determine whether the production of the target product is possible with the current composition of all discrete units n with their modules m in the throughput section D. For this purpose, the control unit makes extensive calculations. It is useful if the control device for the calculations is linked to further calculation systems or can exchange data. A link with a casting model or a pass schedule calculator can support and simplify the calculation necessary for the decision. Further links to a cooling model, a profile and flatness model, an energy consumption calculation, for example based on a model, along with other models can be provided.

If the result of the calculation affirms that the manufacturing of the target product is possible with the current system configuration, manufacturing is initiated. If the ability to manufacture is answered in the negative, the control unit asks whether an alternative target product is to be produced.

If this is affirmed, a modified target product is set. Through the setting of a new target product, even a short shutdown for a necessary module exchange can be avoided in favor of increased productivity, and products that can be manufactured on a uniform line assembly of all discrete units can be produced as a sequence. For this reason, it is helpful to link the setting of the new target product with a production planning system or production control planning. The link to maintenance planning, which for example provides for regular intervals for roll changes or ingot mold changes, can have an additional effect on such decision.

If the manufacturing of an alternative target product is rejected, the control unit determines the necessary composition of the modules m, in conjunction with the composition of all discrete units n in the throughput section. In the following step, the necessary exchange of those modules m whose exchange is necessary to achieve the required composition is initiated. Thus, a new updated composition of all discrete units n with modules m in the throughput section D is ready for the manufacturing of the target product. A modified system configuration is available and manufacturing can be initiated.

Optionally, the control can additionally integrate a change of an operating mode for the manufacturing of a target product. This is shown in FIG. 4 with the dashed additional queries and defaults. The operation of a hot rolling mill 1 in different modes increases its flexibility and its production range. Operating modes ranging from continuous production to batch operation, along with various intermediate forms, are known to the skilled person from the state of the art and will not be described in detail here. In conjunction with the modular structure of the hot rolling train 1, even greater flexibility and an even wider production range can be achieved with the availability of a plurality of operating modes.

The current manner of operation must be known for the operating mode of the controller. If the question of manufacturing an alternative target product is answered in the negative, the next step is to determine whether the intended target product can be manufactured by a different operating mode. For this purpose, the controller makes various calculations that can be supported by the models etc. already specified. If the question is answered in the affirmative, the operating mode is changed and the manufacturing of the target product is thereby enabled. If the question is answered in the negative, the usual subsequent step to determine the necessary composition of the modules m is initiated.

The control device C can be connected in terms of signal technology online to the hot rolling train 1 and/or continuous casting line 6. Yet, it can also work offline. Offline operation can simulate production sequences and thus pre-optimize advance planning of production.

With the overall consideration of the hot rolling mill, its subdivision into discrete units n, at least one of which has a plurality of modules m, a step is taken away from a selective consideration of individual units towards an overall system consisting of connected units n with modules m. The composition of the modules m in conjunction with the sum of the discrete units n within the throughput section D, but also as available exchange modules, allow the entire hot rolling mill to be expanded in terms of its flexibility and its possible production spectrum.

REFERENCE SIGNS

1 Rolling mill
6 Continuous casting line
C Higher-level control system
D Throughput section
m Module
$m_{22.1}$ Roller hearth furnace module
$m_{22.2}$ Roller hearth furnace module
$m_{22.3}$ Roller hearth furnace module
$m_{22.4}$ Open roll table module
$m_{22.5}$ Open roll table module
$m_{22.6}$ Enclosed roll table module
$m_{22.7}$ Cooling section module
$m_{3.1}$ First set of work rolls as the module of the roughing rolling unit
$m_{3.2}$ Second set of work rolls as the module of the roughing rolling unit
$m_{5.1}$ Roll table module
$m_{5.2}$ Roll table module
$m_{5.3}$ Inductive heating module
$m_{5.4}$ Cooling section module
$m_{6.1}$ Funnel-shaped ingot mold as the first module of the continuous casting line
$m_{6.2}$ Parallel ingot mold as the second module of continuous casting line
$m_y$ Module y
N Discrete unit
$n_1$ First discrete unit as the transport unit
$n_2$ Heat treatment unit
$n_2$ Second discrete unit as the
$n_{21}$Pre-heating unit
$n_{22}$ Intermediate heating unit
$n_{23}$ Drive device
$n_{24}$ Drive device
$n_3$ Roughing rolling unit
$n_3$ Roughing rolling unit
$n_4$ Finishing rolling unit
$n_4$ Finishing rolling unit
$n_5$ Transport unit
$n_7$ Separating unit
$n_x$ Discrete unit x
P1 Directional arrow
P2 Directional arrow
S1 Rails
S2 Rails
S3 Rails
T Transport device
$T_1$ Cylinder
$T_2$ Drive unit

The invention claimed is:

1. A system for forming a metallic product along a throughput section, comprising:
a casting facility;
a modular rolling train that is subdivided into discrete units along the throughput section, including
a heat treatment unit,
a roughing rolling unit,
a finishing rolling unit, and
a transport unit for moving the metallic product,
wherein at least one of the discrete units is a subdivided discrete unit comprising at least two modules; and
a transport device assigned to the subdivided discrete unit for exchanging the at least two modules,
wherein a first of the at least two modules of the subdivided discrete unit is configured to be exchanged with a second of the at least two modules by the transport device.

2. The system according to claim 1,
wherein the subdivided discrete unit is the roughing rolling unit, the finishing rolling unit, the transport unit, or the heat treatment unit, and
wherein the one of the at least two modules is a set of rolls of a roughing stand, a set of rolls of a finishing stand, a roll table, an enclosed roll table, a furnace module, a cooling section, a separating unit, a surface treatment unit, or a measuring equipment.

3. The system according to claim 1,
wherein a further of the discrete units is a further subdivided discrete unit with a further transport device being assigned to the further subdivided discrete unit, and
wherein the first of the at least two modules can be exchanged with the second of the at least two modules by a transport operation between the transport device and the further transport device.

4. The system according to claim 3, wherein a length of the modular rolling train is divided into a length grid and a length of the length grid is 0.25 m to 1 m, and wherein dimensions of the discrete units and/or the at least two modules of the modular rolling train are integer multiples of the length of the length grid.

5. The system according to claim 1, wherein the subdivided discrete unit is a heat treatment unit, and wherein the one of the at least two modules of the heat treatment unit is a furnace module, a roll table module, an enclosed roll table module, a cooling section module, a surface treatment module, or a measuring section module.

6. The system according to claim 5, wherein the one of the at least two modules is a roller hearth furnace module.

7. The system according to claim 5, wherein the one of the at least two modules is an induction heating module.

8. The system according to claim 1, wherein the subdivided discrete unit is the roughing rolling unit, and wherein the one of the at least two modules of the roughing rolling unit is a roughing stand with two driven work rolls and/or two support rolls.

9. The system according to claim 1, wherein the subdivided discrete unit is the finishing rolling unit, and wherein the one of the at least two modules of the finishing rolling unit is a finishing roll stand with two driven work rolls and/or two support rolls.

10. The system according to claim 1, wherein the modular rolling train is a hot rolling train, configured for forming one of different cast products comprising different materials and/or having different dimensions that can be produced by the casting facility, and wherein the modular hot rolling train is configured to receive the different cast products directly after a casting and solidification process.

11. The system according to claim 10, wherein the casting facility is a continuous casting line, and wherein an ingot mold of the continuous casting line can be exchanged to change dimensions of the metallic product.

12. The system according to claim 1, wherein the casting facility is a continuous casting line with an exchangeable ingot mold, wherein the modular rolling train further includes a second heat treatment unit between the roughing rolling unit and the finishing rolling unit, and a third heat treatment unit after the finishing rolling unit, and wherein the second heat treatment unit is the subdivided discrete unit.

13. The system according to claim 12, wherein the modular rolling train can be adjusted to different materials and dimensions of the metallic product by exchanging the at least two modules of the second heat treatment unit, wherein the second heat treatment unit includes a fixed section and four exchangeable modules, wherein two of the four exchangeable modules are arranged in the throughput section, and wherein two of the four exchangeable modules are roller hearth furnace modules and two of the four exchangeable modules are open roll tables.

14. The system according to claim 1, further comprising a higher-level control or regulation system for the modular rolling train and associated control or regulation system for the discrete units and/or the at least two modules, wherein the higher-level control or regulation system can initiate and execute an automatic exchanging of the at least two modules.

15. The system according to claim 1, wherein the transport device is an overhead crane.

16. The system according to claim 1, wherein the transport unit includes two roll table modules, and the two roll table modules are moved along rails using the transport device.

17. A method for operating a modular rolling train for forming a metallic product, the modular rolling train being subdivided into discrete units along a throughput section, including a heat treatment unit, a roughing rolling unit, a finishing rolling unit, and a transport unit for moving the metallic product, wherein at least one of the discrete units is a subdivided discrete unit comprising at least two modules, and wherein the modular rolling train further includes a transport device assigned to the subdivided discrete unit for exchanging the at least two modules, the method comprising:

effecting a desired change in format and/or material of the metallic product by adjusting a process control in the modular rolling train based on production parameters, including checking whether the production parameters can be achieved by a roll gap adjustment and/or adjustment of cooling parameters with modules that are present in the throughput section; and automatically exchanging unsuitable ones of the modules that are present in the throughput section with modules suitable for compliance with the production parameters.

18. The method according to claim 17, wherein automatically exchanging the modules is performed within 10 min.

19. The method according to claim 17, further comprising:

suggesting, by a higher-level control system, alternative formats and/or materials if no modules suitable for maintaining the production parameters can be exchanged with one another.

20. The method according to claim 19, further comprising:

using, by the higher-level control system, process models for discrete units and/or modules.

21. The method according to claim 19, further comprising:

exchanging data between the higher-level control system and a production planning system.

22. The method according to claim 19, further comprising:

optimizing, by the higher-level control system, in conjunction with a production planning system production sequences in terms of material, dimensions, throughput and/or deadlines.

* * * * *